United States Patent [19]

van Geffen

[11] 3,939,683

[45] Feb. 24, 1976

[54] PIERCING TOOLS

[76] Inventor: Johannes Adrianus van Geffen, Oratoriumstradt 9, Apeldoorn, Netherlands

[22] Filed: Dec. 19, 1974

[21] Appl. No.: 534,412

[30] Foreign Application Priority Data

Nov. 28, 1974 Netherlands ..... 7415559

[52] U.S. Cl. ..... 72/71; 72/325; 72/112

[51] Int. Cl.[2] ..... B21D 28/36

[58] Field of Search ..... 72/70, 71, 112, 120, 325, 72/327; 83/660; 29/157 T; 10/140, 141 R

[56] References Cited

UNITED STATES PATENTS

| | | | |
|---|---|---|---|
| 3,195,156 | 7/1965 | Phipard, Jr. | 72/71 |
| 3,251,080 | 5/1966 | Sharon | 10/141 |
| 3,277,683 | 10/1966 | Knoblock | 72/71 |
| 3,429,171 | 2/1969 | Feher | 72/325 |

*Primary Examiner*—Lowell A. Larson

*Attorney, Agent, or Firm*—John P. Snyder

[57] ABSTRACT

A rapidly rotatable piercing tool of hard material for forming by frictional heat and pressure a hole surrounded by a boss in a metal plate or the wall of a metal pipe, the pipe part for making the hole to size having basically triangular cross sectional areas the contour line of which has three outwardly curved legs of a shape to make the piercing tool expecially adapted to forcing bossed holes both in ductile and in hard metals.

5 Claims, 2 Drawing Figures

PIERCING TOOLS

Figure 2:
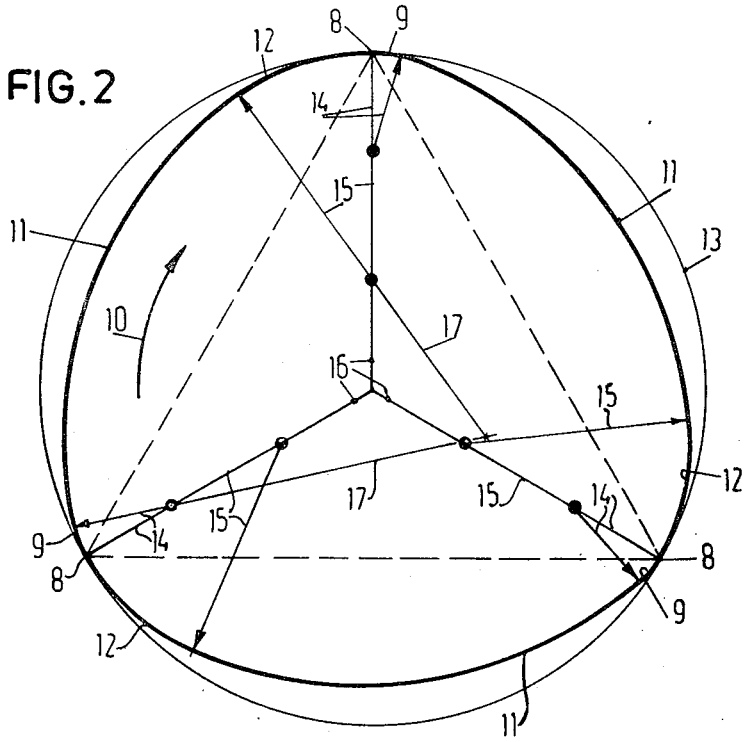

The invention relates to a rapidly rotatable piercing tool of hard material for forming, substantially by frictional heat and pressure, a hole surrounded by a boss in a metal plate or the wall of a metal pipe, said tool being constructed in such a way that its active part for making the diameter of the hole to size has a leading portion extending to and tapering towards the free end of the tool and has cross sectional areas, of each one of which the basic shape is an equilateral triangle.

Piercing tools of this kind have been proposed for making bossed holes in plates and pipe walls of ductile metal, such as aluminium and copper. The active part of these known piercing tools have cross sectional areas, the contour line of which has the exact shape of an equilateral triangle or a shape, of which the base is such a triangle but the legs are concave.

It has been found however, that the known piercing tools can not be used well for making bossed holes in harder metals, such as iron and mild steel. It has appeared that for this purpose the piercing tool has to satisfy rather strict conditions and it is the object of the invention to provide piercing tools which meet these conditions.

According to the invention a piercing tool which is adapted to make bossed holes both in ductile and in rather hard metals must have an active part having basically triangular cross sectional areas, of each one of which the contour line consists in and near each angular point of the basic triangle of two arcs adjoining each other and touching the circumscribed circle of said triangle in the respective angular point and of connecting lines interconnecting and blending with said arcs, in which the radii of curvature of said arcs are smaller than that of the mentioned circumscribed circle and the arcs which extend from the angular points of the basic triangle in the direction of rotation of the piercing tool have in each one of their points a radius of curvature which is smaller than any radius of curvature of the arcs extending from said angular points in opposite direction.

Although for each metal to be worked by the piercing tool cross sectional shapes can be found within the scope of the invention which have an optimal effect, it has been found that in many cases satisfactory results are obtained when in the cross sectional areas of the active part of the tool the connecting lines of the contour lines are also curved and have in each one of their points a radius of curvature which is greater than the radius of the circumscribed circle of the basic triangle of the respective area.

The grinding of the tools to the exact shape and size can be considerably facilitated and the manufacture of the rather expensive tools can thereby be made cheaper, when the piercing tools are so shaped that the curved connecting lines end/or the arcs adjoining each other in the angular points of the basic triangles of the contour lines of the cross sectional areas of the active parts of the tools are arcs of circles.

Figure 1:
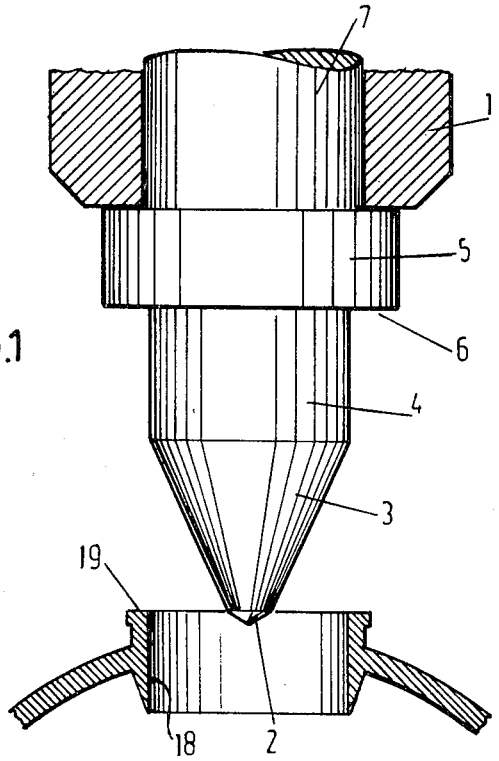

The invention will be further elucidated with the aid of the accompanying drawing, in which FIG. 1 shows a sectional view of a portion of a pipe and an elevational view of a piercing tool according to the invention and FIG. 2 is, on an enlarged scale, a view of each cross sectional area of the active part of the piercing tool shown in FIG. 1.

In FIG. 1 a part of a chuck of a drilling machine or an other machine tool having a fast rotating spindle is designated by 1. Clamped in the chuck is a piercing tool of a very hard metal alloy. This piercing tool consists of a small free end portion in the shape of a centre point 1, a tapered second portion 3 tapering towards the centre point 2, a cylindrical third portion 4 adjoining said second portion 3, a circularly cylindrical portion 5 having a diameter which is greater than the maximum diameters of the portions 3 and 4, so that a shoulder 6 is formed, and a shank 7 for the attachment of the piercing tool in the chuck 1.

The part of the tool which is active to make the diameter of the bossed hole to size consists of the second and the third portion 3, 4. This active part of the tool has similar cross sectional areas, one of which is shown in FIG. 2 on an enlarged scale.

The contour line of the cross sectional areas of the tool portions 3 and 4 shown in FIG. 2 is characterized by a basic shape in the form of an equilateral triangle having angular points 8 and by curved legs of said triangle. Each leg consists of an arc 9 extending from an angular point 8 in the direction of rotation 10, a connecting arc 11 and an arc 12 extending from the next angular point 8 in the direction opposite to the direction of rotation. All arcs 9, 11, 12 blend with each other and the arcs 9 and 12 touch in the angular points 8 the circumscribed circle 13. The radius of curvature 14 in each point of the arc 9 and the radius of curvature 15 in each point of the arc 12 are smaller than the radius 16 of the circumscribed circle 13 and the radius of curvature 14 is smaller than the radius of curvature 15. The radius of curvature 17 in each point of the connecting arc 11 is greater than the radius 16 of the circumscribed circle.

In the embodiment all arcs 9, 11, 12 are arcs of circles. It appears that a piercing tool having the active surfaces of the tool according to the described embodiment can be ground in the required shape in a much easier way than a piercing tool having curved surfaces of which the cross sectional areas are not bounded by arcs of circles. However, it is observed that, for instance, the connecting lines 11 of the contour line may be straight lines, so that the corresponding surfaces of the active part of the piercing tool are flat. It has been found that the grinding of flat surfaces to the piercing tool requires rather intricate machine tools.

When a piercing tool of the described construction is forced, when spinning rapidly, through the wall of a metal pipe or through a metal plate, a boss 18, as illustrated in FIG. 1, is formed. The shoulder 6 of tool portion 5 smoothes the end face 19 of said boss 17.

What I claim is:

1. A rapidly rotatable piercing tool of hard material for forming, substantially by frictional heat and pressure, a hole surrounded by a boss in a metal plate or the wall of a metal pipe, the active part of said tool for making the diameter of the hole to size having a leading portion extending to and tapering towards the free end of the tool, said active part of the tool having cross sectional areas, of each one of which the basic shape is an equilateral triangle, each cross sectional shape consisting in and near each apex of said triangle of two arcs adjoining each other and touching the circumscribing circle of said triangle at the respective apex and of connecting lines interconnecting and blending with said arcs, the radii of curvature of said arcs being smaller than that of said circumscribing circle and the arcs which extend from the apices of the triangle in the direction of rotation of the piercing tool having a radius of curvature which is smaller than any radius of curvature of the arcs extending from said apices in the opposite direction.

2. A piercing tool as claimed in claim 1, in which each connecting line is also curved and has a radius of curvature which is greater than the radius of said circumscribing circle.

3. A piercing tool as claimed in claim 2, in which the curved connecting lines are arcs of a circle.

4. A piercing tool as claimed in claim 1, in which the arcs adjoining each other in the apices of the triangle are arcs of circles.

5. A piercing tool as defined in claim 1 wherein each of said arcs and each of said connecting lines are arcs of circles; each arc which extends in the direction of rotation from an apex having its center of curvature lying on a line connecting the center of said circumscribing circle and the apex at which such arc commences; each arc which extends in the opposite direction from an apex having its center of curvature lying on a line connecting the center of said circumscribing circle and the apex at which such arc terminates; each said arc which extends in the direction of rotation from a respective apex terminating at a point such that the radius at that point when extended intersects a line between the center of said circumscribing circle and another apex at the center of curvature of that one of said arcs which extends in the opposite direction from said another apex; and each said arc, which extends in the opposite direction from an apex, commencing at a point such that the radius at such commencing point when extended, intersects the radius extended from the terminal point of that arc with which it is joined by an intervening connecting line, at a connecting line center point which is adjacent to but spaced from one of the lines between said center of the circumscribing circle and an apex, the connecting line center point being the center of said intervening connecting line.

* * * * *